US005174559A

United States Patent [19]

Diamantides

[11] Patent Number: 5,174,559

[45] Date of Patent: Dec. 29, 1992

[54] SHEET MATERIAL HANDLING APPARATUS AND METHOD USING A SKEWED SHEET STACK AND AN ALIGNMENT MECHANISM

[75] Inventor: George J. Diamantides, Dayton, Ohio

[73] Assignee: AM International Incorporated, Chicago, Ill.

[21] Appl. No.: 769,203

[22] Filed: Sep. 30, 1991

[51] Int. Cl.[5] ..... B65H 5/08; B65H 9/00

[52] U.S. Cl. ..... 271/12; 271/100; 271/235; 271/271

[58] Field of Search ..... 271/11, 12, 94, 95, 271/99-101, 234, 235, 271

[56] References Cited

U.S. PATENT DOCUMENTS

| | | | |
|---|---|---|---|
| 1,875,189 | 8/1932 | Winkler et al. . | |
| 2,963,292 | 12/1960 | Büttner | 271/11 |
| 3,650,525 | 3/1972 | Hageman et al. . | |
| 3,702,187 | 11/1972 | Hageman et al. . | |
| 3,953,018 | 4/1976 | Maopolski . | |
| 4,127,262 | 11/1978 | Eberle et al. | 271/12 |
| 4,198,039 | 4/1980 | Bryson et al. . | |
| 4,331,327 | 5/1982 | Felix | 271/12 |
| 4,657,236 | 4/1987 | Hirakawa et al. . | |
| 5,106,070 | 4/1992 | Reist | 271/12 |

FOREIGN PATENT DOCUMENTS

| | | | |
|---|---|---|---|
| 1128892 | 8/1956 | France | 271/11 |

*Primary Examiner*—Robert P. Olszewski
*Assistant Examiner*—Steven M. Reiss
*Attorney, Agent, or Firm*—Tarolli, Sundheim & Covell

[57] ABSTRACT

An apparatus for handling sheet material articles includes a hopper which supports a stack of sheet material articles with front edge portions of the articles skewed at an acute angle to the axis of rotation of a feed drum. A separator is sequentially engageable with a corner portion of each of the sheet material articles to move the corner portion of the sheet material article away from a next succeeding sheet material article. The feed drum pulls a sheet material article from the hopper with the front edge portion of the sheet material article skewed at an acute angle to the axis of rotation of the feed drum. While a portion of the sheet material article is still in the hopper, the sheet material article moves from between the separator and the next succeeding sheet material article to expose the next succeeding sheet material article to the separator. A conveyor receives the sheet material article from the feed drum. A plurality of alignment rods engage a leading end portion of the sheet material article as it moves toward the conveyor and rotates the sheet material article into alignment with the conveyor.

20 Claims, 3 Drawing Sheets

SHEET MATERIAL HANDLING APPARATUS AND METHOD USING A SKEWED SHEET STACK AND AN ALIGNMENT MECHANISM

BACKGROUND OF THE INVENTION

The present invention relates to an apparatus and method for use in handling sheet material and more specifically to an apparatus and method for feeding sheet material articles from a hopper.

Known apparatus for feeding sheet material articles is disclosed in U.S. Pat. Nos. 3,650,525 and 3,702,187. This apparatus includes a hopper which supports a stack of sheet material articles. A separator is engageable with a front edge portion of a sheet material article to pull the sheet material article downwardly toward a pickup location. A feed drum has a plurality of spaced apart grippers which sequentially grip sheet material articles at the pickup location. The feed drum pulls the sheet material articles from the hopper and moves the sheet material articles to receiving locations on a conveyor disposed beneath the feed drum.

In an apparatus of the type disclosed in the aforementioned patents, the grippers on a feed drum are disposed at equally spaced increments along the periphery of the feed drum. The distance between adjacent grippers is sufficient to support a sheet material article throughout the length of the sheet material article. In addition, there is sufficient distance between the rear or trailing edge portion of a first sheet material article and the front or leading edge portion of a next succeeding sheet material article to allow the separator to move the front edge portion of the second sheet material article to the pickup location during rotation of the feed drum after feeding of the first sheet material article from the hopper.

For example, when twelve inch long sheets are to be fed from a hopper, the distance along the surface of the feed drum between adjacent grippers may be eighteen inches. This eighteen inches includes twelve inches for engagement with the side surface of a sheet material article. The additional six inches of drum circumference is required to enable the separator to engage and move a front edge portion of the next succeeding sheet material article to the pickup location.

The distance which must be provided along the circumference of the drum to enable the separator to move a front edge portion of a sheet material article to the pickup location decreases the extent of the peripheral surface of the drum which is available for engagement with the sheet material article. Therefore, the maximum length of the sheet material article which can be handled by a particular feed drum is a function of both the diameter of the drum and the time required for the separator to engage and move the front edge portion of a sheet material article to a pickup location.

SUMMARY OF THE INVENTION

The present invention relates to a new and improved method and apparatus for handling sheet material articles. During operation of the apparatus, a drum is rotated to feed sheet material articles from a hopper. The hopper supports the sheet material articles in a stack with front edge portions of the sheet material articles skewed at an acute angle to an axis of rotation of the drum. A separator is operable to engage front edge portion of a sheet material article and to separate the front edge portion of the sheet material article from a next succeeding sheet material article.

During rotation of the drum, grippers on the feed drum grip the front edge portion of the sheet material article. During continued rotation of the drum, the grippers pull the gripped sheet material article from the hopper with the front edge portion of the sheet material article skewed at an acute angle to the axis of rotation of the drum and parallel to front edge portions of other sheet material articles in the stack of sheet material articles. As the gripped sheet material article is pulled from the hopper, the sheet material article is moved along a path which is skewed relative to the sides of the stack of sheet material articles to expose the next succeeding sheet material article to the separator during movement of the gripped sheet material article from the hopper.

A conveyor receives the sheet material articles from the feed drum and moves the sheet material articles along a path which is skewed to the stack of sheet material articles. As each sheet material article in turn moves from the feed drum toward the conveyor, the sheet material article is rotated to align the sheet material article with the conveyor.

BRIEF DESCRIPTION OF THE DRAWINGS

The foregoing and other features of the present invention will become more apparent upon a consideration of the following description taken in connection with the accompanying drawings wherein.

DESCRIPTION OF ONE SPECIFIC PREFERRED EMBODIMENT OF THE INVENTION

Figure 1:
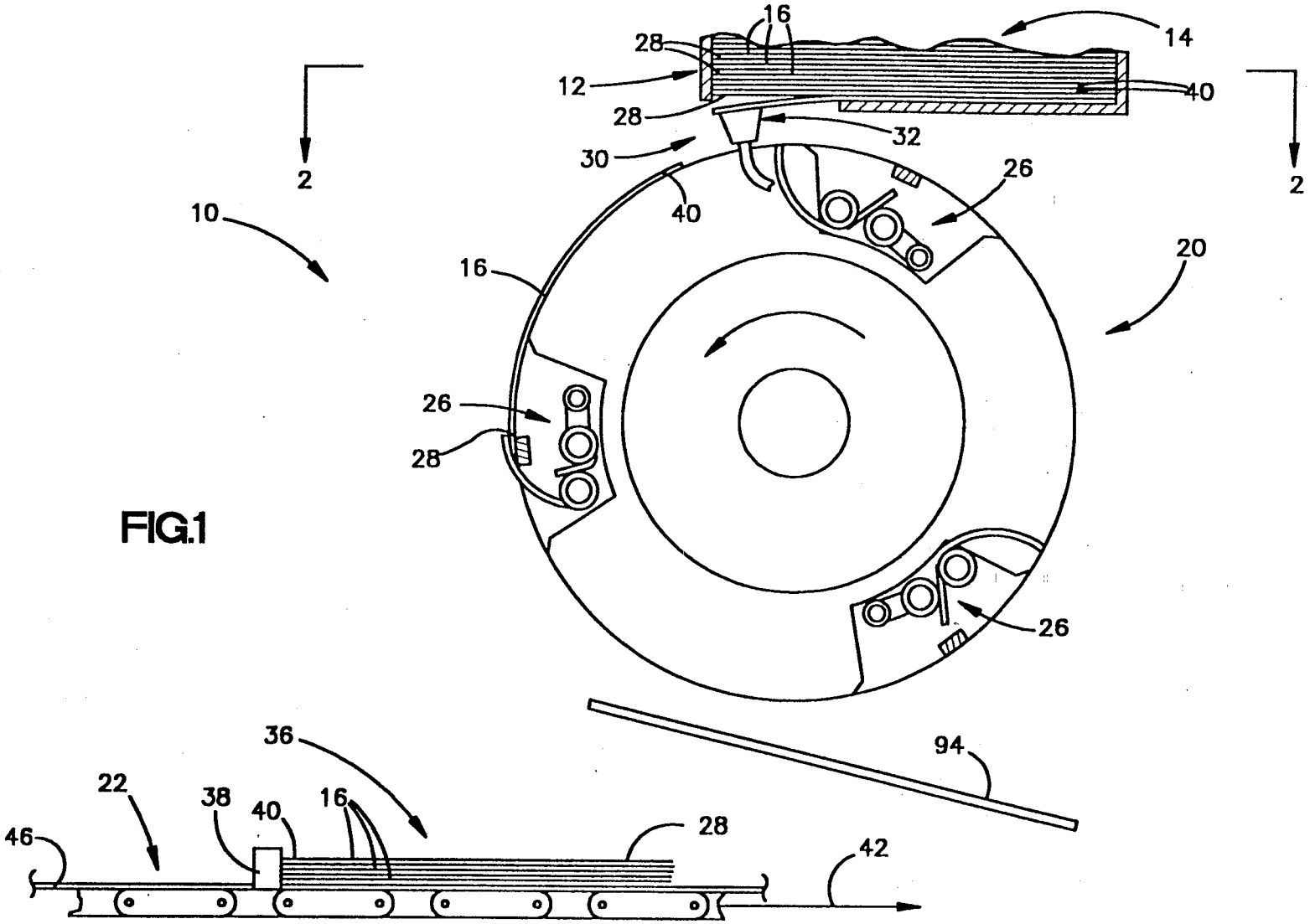
FIG. 1 is a schematic illustration of a sheet material handling apparatus constructed and operated in accordance with the present invention and illustrating the relationship of a feed drum to a stack of sheet material articles in a hopper and to a conveyor which receives sheet material articles from the feed drum.

An apparatus 10 for use in handling sheet material articles is illustrated schematically in FIG. 1. The apparatus 10 includes a rectangular hopper 12 which holds a stack 14 of rectangular sheet material articles 16. The sheet material articles 16 may be signatures, newspaper sections, individual sheets of material, or other sheet material items.

A feed drum 20 is rotatable to sequentially feed sheet material articles from the hopper 14 to a conveyor 22. A plurality of gripper assemblies 26 are disposed at equally spaced apart locations about the circumference of the feed drum 20. The gripper assemblies 26 are operable to grip a front or leading edge portion 28 of a sheet material article 16 at a pickup location 30 adjacent to the lower portion of the hopper 12.

A sucker or separator 32 grips the lower side of the front edge portion 28 of the lowermost sheet material article 16 in the stack 14 by applying suction or vacuum to the lower side of the sheet material article. While the separator 32 continues to apply suction to the lower side of the sheet material article 16, the separator pulls the front edge portion 28 of the sheet material article downwardly away from the next sheet material article to the pickup location 30. When the front edge portion 28 of a sheet material article 16 has been pulled downwardly to the pickup location 30, the front edge portion of the sheet material article is spaced apart from the front edge portion of the next succeeding sheet material article in the stack 14 of sheet material articles.

As the feed drum 20 rotates and moves a gripper assembly 26 to the pickup location, the gripper assembly is operated to grip the front edge portion 28 of the sheet material article. At the same time, the application of suction to the lower side of the sheet material article 16 by the separator 32 is interrupted to release the front edge portion 28 of the sheet material article 16. Continued rotation of the feed drum 20 then pulls the sheet material article 16 from the hopper 12.

As a sheet material article 16 is pulled from the hopper 12 by rotation of the feed drum 20, the feed drum moves the front edge portion 28 of the gripped sheet material article 16 downwardly toward the conveyor 22. After the sheet material article 16 has been pulled completely out of the hopper 12, the gripper assembly 26 is operated to release the sheet material article for movement to a receiving location 36 on the conveyor 22. A pusher finger 38 then engages a trailing or rear edge portion 40 of the sheet material article to move the article rightwardly, as viewed in FIG. 1, along a linear path in the manner indicated by the arrow 42 in FIG. 1.

The hopper 12, feed drum 20, separator 32 and conveyor 22 may have many different known constructions. However, in the illustrated embodiment of the invention, they have the same construction as is disclosed in U.S. Pat. Nos. 3,650,525 and 3,702,187. In addition, the separator may include a disk-like rotary separator, in the manner disclosed in the aforementioned patents, if desired. The conveyor 22 is of the well known flatbed type and has a flat tray or raceway 46 which supports the sheet material articles 16 for movement in the direction of the arrow 42. However, the conveyor and the apparatus for transferring the sheet material articles 16 to the conveyor could have many different constructions, such as constructions similar to those shown in U.S. Pat. Nos. 3,953,018; 4,198,039 and 4,657,236 if desired.

In order to maximize the amount of time during which the separator 32 is exposed to the front edge portion 28 of a sheet material article 16 in the hopper 12 during rotation of the feed drum 20 while minimizing space between adjacent sheet material articles engaged by the feed drum, the hopper and stack 14 of sheet material articles are skewed at an acute angle to an axis 50 (FIG. 2) about which the feed drum rotates. The feed drum 20 is supported for rotation by a horizontal drive shaft 52 having a central axis 50. The rectangular hopper 12 has a front side wall 56. A flat vertically extending front registration surface 60 on the front side wall 56 of the hopper engages a front side 62 of the stack 14. The front registration surface 60 of the hopper 12 and front side 62 of the stack 14 are skewed at an acute angle, indicated at 64 in FIG. 2, to the central axis 50 of the feed drum 20.

The central axis 50 of the feed drum 20 extends perpendicular to a longitudinal central axis 66 of the conveyor 22. The front registration surface 60 of the hopper 12 and the front side 62 of the stack 14 are skewed at an acute angle, indicated at 68 in FIG. 2, to the central axis 66 of the conveyor 22. The acute angle 68 at which the front registration surface 60 of the hopper 12 and front side 62 of the stack 14 are skewed relative to the central axis 66 of the conveyor 22, is the complement of the acute angle 64.

Figure 2:
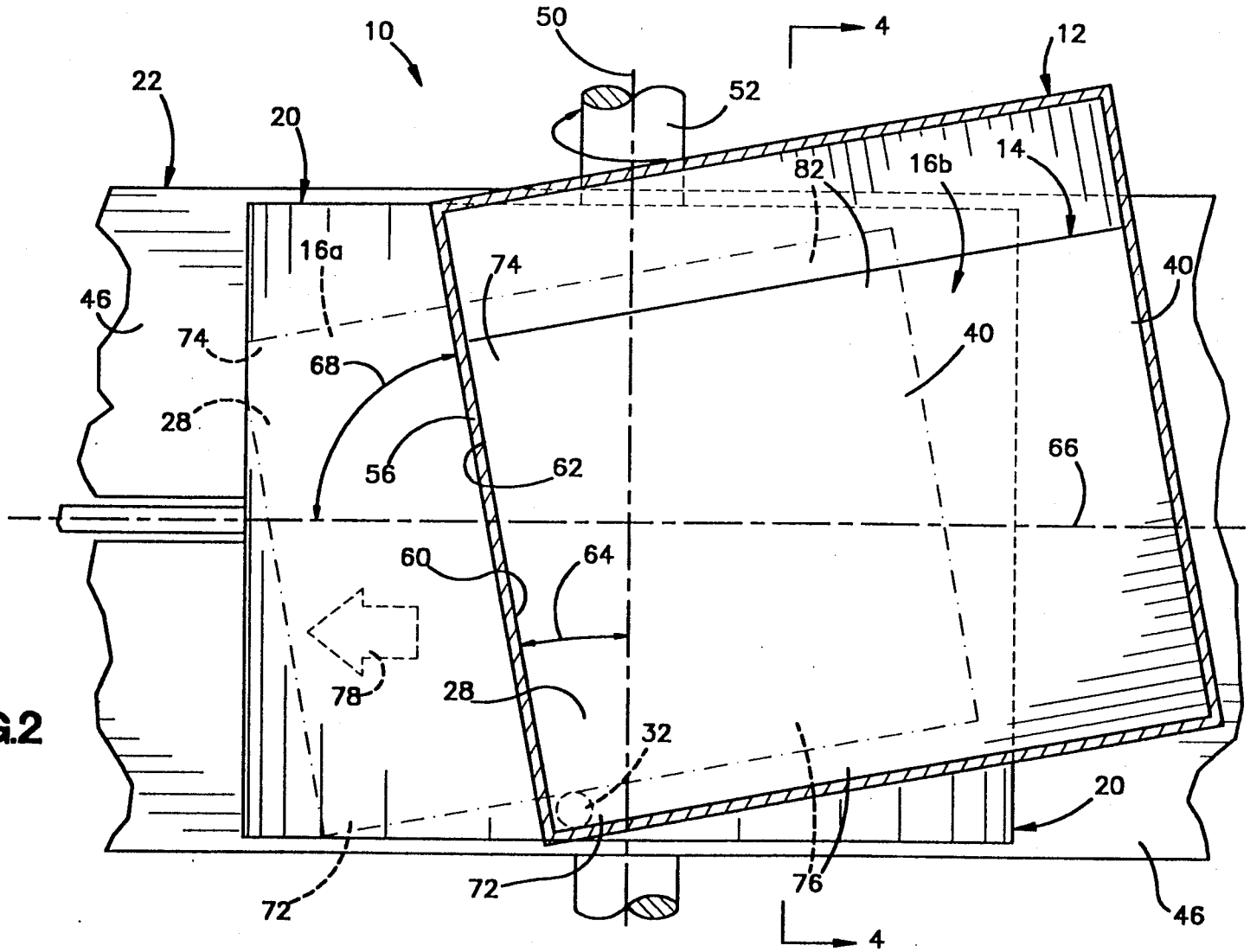
FIG. 2 is a plan view, taken generally along the line 2—2 of FIG. 1 and schematically illustrating the manner in which the stack of sheet material articles in the hopper is skewed at an acute angle to the axis of rotation of the feed drum and to the path of movement of the conveyor.

It should be understood that, for purposes of clarity of description, the acute angle 64 has been illustrated in FIG. 2 as being somewhat larger than may be used in actual embodiments of the invention. Thus, in FIG. 2, the acute angle 64 has been shown as being approximately 10°. In one embodiment of the invention in which the feed drum 20 had three sets 26 of grippers, as shown in FIG. 1, the acute angle 64 was approximately 6.5°. In another embodiment of the invention in which the feed drum 20 had four sets of grippers 26, the acute angle 64 was approximately 8°. Although it is contemplated that the acute angle 64 will be different in different embodiments of the invention, it is believed that the acute angle 64 will probably be less than 15° in order to avoid excessive skewing of the sheet material article 16 relative to the feed drum 20 and conveyor 22.

Skewing the stack 14 of sheet material articles 16 relative to the axis of rotation of the feed drum 20 results in the front corner portion 72 of the lowermost sheet material article moving from between the separator 32 and the next succeeding sheet material article before the lowermost sheet material article has been completely pulled from the hopper 12 during rotation of the feed drum. This exposes the separator 32 to the front corner portion 72 of the next succeeding sheet material article 16 after the lowermost sheet material article has only been partially pulled from the hopper 12 by the feed drum 20. The lowermost sheet material article, which has been partially pulled from the hopper 12, is designated as **16*a* in FIG. 2, while the next succeeding sheet material article has been designated as 16*b* in FIG. 2. The lowermost sheet material article 16*a* is shown in FIG. 2 in a position in which it has just been pulled from between the separator 32 and corner portion 72 of the next succeeding sheet material article 16*b***.

The feed drum 20 pulls the first or lowermost sheet material article **16*a* from the hopper 12 along a path which extends perpendicular to the axis 50 about which the feed drum 20 rotates and parallel to the arrow 78 in FIG. 2. Due to the skewed orientation of the front edge portion 28 of the stack 14 relative to the feed drum 20, the front corner portion 74 of the lowermost sheet material article 16*a* leads the front corner portion 72** of the lowermost sheet material article.

Figure 3:
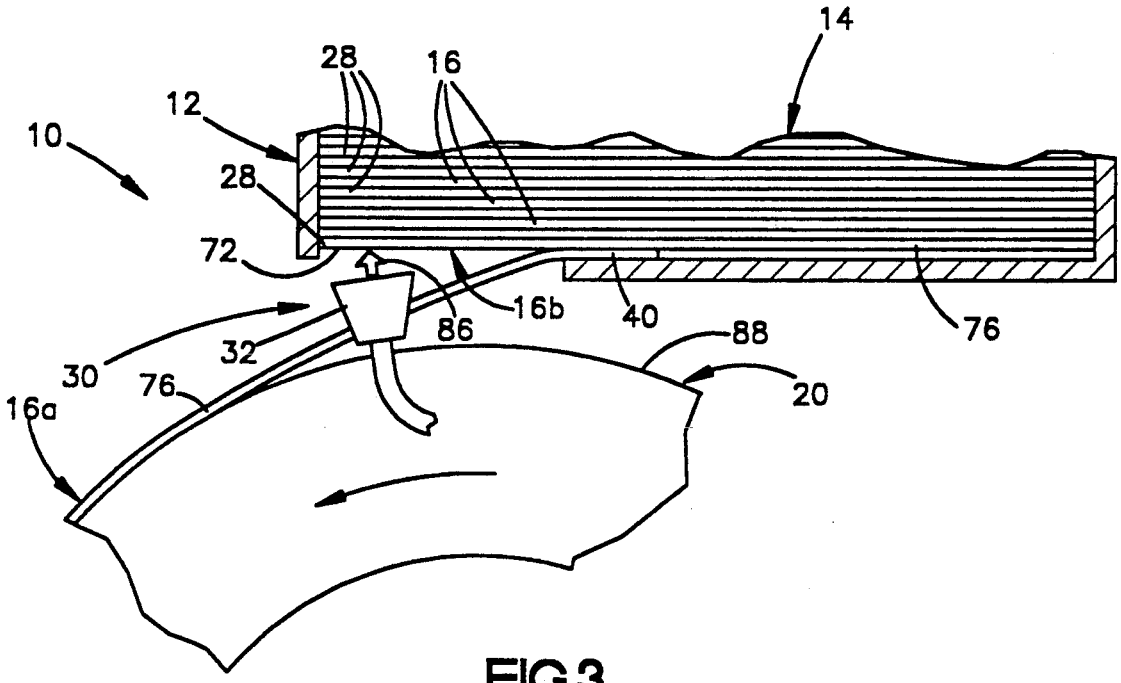
FIG. 3 is an enlarged fragmentary schematic sectional view illustrating the manner in which a separator is exposed to a next succeeding sheet material article during pulling of the preceding sheet material article out of the hopper by the feed drum.

As the front edge portion 28 of the lowermost sheet material article **16*a* moves forwardly, a relatively long first side edge portion 76 of the lowermost sheet material article 16*a* moves away from the first side edge portion 76 of the next succeeding sheet material article 16*b*. When the lowermost sheet material article 16*a* has moved forwardly to the position shown in FIG. 2, the first side edge portion 76 of the lowermost sheet material article 16*a*** will have just moved clear of the separator 32. At this time, a second side edge portion 82 of the first sheet material article 16*a*, which extends parallel to the first side edge portion 76 of the sheet material article, has moved clear of the side edge portion 82 of the next succeeding or second sheet material article 16*b* (see FIG. 2). At this time, the front corner portion 72 of the next succeeding sheet material article 16*b* is exposed to the separator 32. Therefore, the separator 32 can move upwardly (as viewed in FIG. 3) and grip the exposed lower side of the front corner portion 72 of the next succeeding sheet material article 16*b* in the stack 14.

Although the separator 32 is exposed to the front corner portion 72 of the next succeeding sheet material article 16*b*, more than fifty percent (50%) of the upwardly facing major side surface of the first sheet material article 16*a* is disposed in abutting sliding engagement with the downwardly facing major side surface of the next succeeding sheet material article 16*b*. This enables the separator 32 to move upwardly (as indicated by the arrow 86 in FIG. 3) into gripping engagement with the front corner portion 72 of the next succeeding sheet material article 16*b* as the lowermost sheet material article 16*a* is being pulled out of the hopper 12 by the feed drum 20. Since the separator 32 can move upwardly into gripping engagement with the front corner portion 72 of the next succeeding sheet material article 16*b* as the preceding sheet material article 16*a* is being pulled from the hopper 12 by the feed drum 20, the interval or surface space on the feed drum 20 between the rear edge portion 40 of the sheet material article 16*a* and the front edge portion 28 of the sheet material article 16*b* can be minimized. This enables the length of the sheet material articles 16 to be maximized.

For example, in a known sheet material handling apparatus in which the feed drum 20 has a circumference of fifty-four (54) inches and three grippers, eighteen (18) inches are provided on the periphery of the feed drum between leading edge portions of the gripper assemblies. This known sheet material handling apparatus requires a space of six (6) inches between the trailing edge of one sheet material article and the leading edge of the next succeeding sheet material article to enable the separator 32 to move the sheet material article to a pickup location 30 and to enable a gripper assembly 26 to be operated to grip the sheet material article at the pickup location. Therefore, the maximum length of the sheet material articles which can be fed by this known sheet material handling apparatus is twelve (12) inches.

By skewing the front edge portion 72 of the sheet material articles 16 in the stack 14 at an angle 64 (FIG. 2) of six degrees thirty minutes (6° 30″) relative to the feed drum axis 50, the required distance along the cylindrical outer side surface 88 of the feed drum 20 between the rear or trailing edge 40 of one sheet material article 16 and the leading or front edge 28 of a next succeeding sheet material article is reduced from six (6) inches to two (2) inches. This results in a four (4) inch increase in the length of the sheet material articles which can be fed by the feed drum 20. Thus, with the known sheet material handling apparatus previously referred to having a feed drum 20 with three gripper assemblies 26 and a circumference of 54 inches, the maximum length of the sheet material articles which can be fed by the feed drum is increased from twelve (12) inches to sixteen (16) inches.

Although skewing the stack 14 of sheet material articles relative to the path of movement of the articles results in the front corner portion 72 of a next succeeding article 16*b* being exposed early in an operating cycle, the separator 32 does not pull the front edge portion 28 of the sheet material article 16*b* downwardly to the pickup location 30 until after the preceding sheet material article 16*a* has been pulled from the hopper 12 by the feed drum. This is done in order to prevent interference between the sheet material articles and to prevent the sheet material article 16*b* from being pulled out of its intended position by the preceding sheet material article 16*a*.

During continued rotation of the feed drum 20, the front edge portion 28 of the sheet material article 16 moves downwardly away from the hopper 12 to a position directly above the conveyor support surface or raceway 46. The drum mounted gripper assembly 26 holding the sheet material article 16 is then operated to a disengaged condition to release the sheet material article at a receiving location 36 (FIG. 1) on the conveyor 22. As the sheet material article 16 is released, the front corner portion 74 will be closer to the conveyor support surface 46 than the opposite front corner portion 72 (see FIG. 4). Thus, the sheet material article is skewed relative to the longitudinal central axis 66 (FIG. 2) of the conveyor 22.

Figure 4:
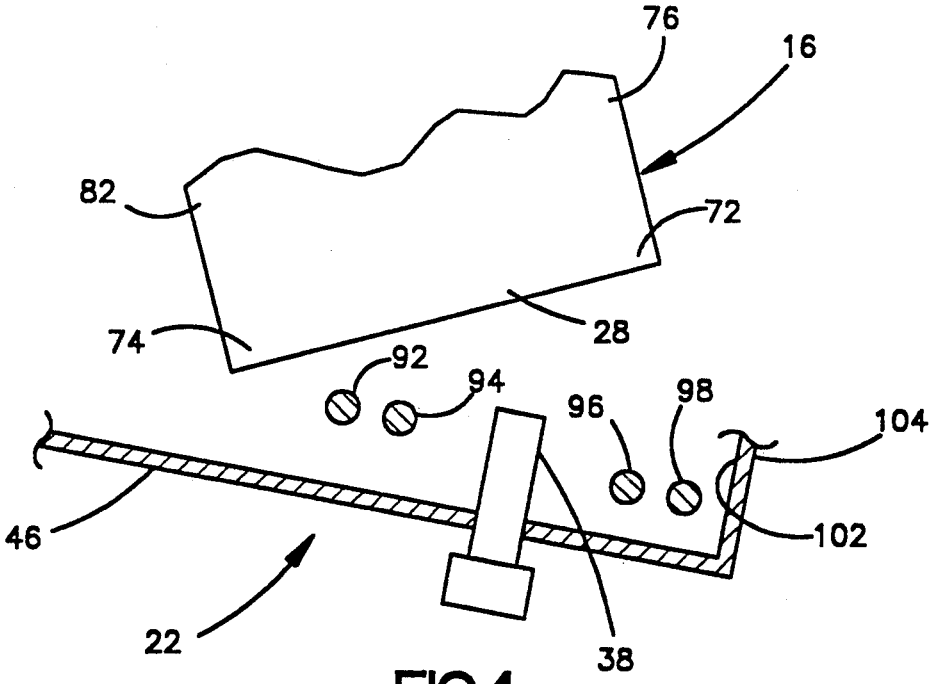
FIG. 4 is a schematic sectional view, on a reduced scale and taken generally along the line 4—4 of FIG. 2, illustrating the relationship between a front or leading edge portion of a sheet material article and positioning rods for rotating the article to align it with the conveyor as the article is transferred from the feed drum to the conveyor.

In order to provide for alignment of the sheet material article 16 with the receiving location 36 (FIG. 1) on the conveyor 22, the sheet material article must be rotated slightly to move the sheet material article into an orientation in which the front edge portion 28 of the sheet material article is perpendicular to the longitudinal central axis 66 of the conveyor and is parallel to the support surface 46. This is accomplished by the use of parallel alignment rods 92, 94, 96, and 98. The parallel alignment rods 92, 94, 96 and 98 slope downwardly from the feed drum 20 toward the conveyor 22 (FIGS. 1 and 4). Although the alignment rods 92, 94, 96 and 98 extend parallel to each other, they are disposed on different levels (FIG. 4).

As the sheet material article 16 moves downwardly toward the conveyor support 46, the front edge portion 28 of the sheet material article engages the upper alignment rod 92 at a location adjacent to the leading front corner portion 74. As the sheet material article 16 continues to move downwardly, the article pivots about the location where it engages the alignment rod 92 and the front edge portion 28 moves into engagement with the alignment rod 94. The combined downward and pivotal movement of the sheet material article continues until the front edge portion 28 of the sheet material article 16 engages the alignment rods 96 and 98. When this occurs, side edge portion 76 of the sheet material article 16 extends parallel to the longitudinal central axis 66 of the conveyor 22 and to a guide surface 102 formed on a lip or edge portion 104 of the conveyor support 46. Therefore, as the pusher finger 38 moves into engagement with the rear or trailing edge portion 40 (FIG. 2) of the sheet material article 16 and the sheet material moves past the ends of the alignment rods 92, 94, 96 and 98, the sheet material article is aligned with the conveyor 24 and is positioned for subsequent handling operations.

The alignment rods 92, 94, 96 and 98 extend for a relatively short distance along the conveyor 22. Thus, the alignment rods 92, 94, 96 and 98 extend along the conveyor 22 from a location immediately ahead of the feed drum 20 to a location shortly after the feed drum. The alignment rods 92, 94, 96 and 98 slope downwardly toward the flat surface 46 of the conveyor 22. Although the alignment rods 92 and 94 extend parallel t the guide rods 96 and 98 throughout their length, the alignment rods 92 and 94 are spaced further from the flat surface 46 of the conveyor 22 than are the alignment rods 96 and 98. However, the alignment rods 96 and 98 are spaced a sufficient distance from the flat support surface 46 of the conveyor 22 to enable a group of sheet material articles at a receiving location 36 immediately ahead of a pusher finger 38 to freely move between the alignment rods and the flat conveyor support 46 throughout the length of the alignment rods.

Although it is preferred to use the alignment rods 92, 94, 96, and 98 to align sheet material articles with the conveyor 22, the alignment rods may be omitted if desired with certain types of conveyors and/or sheet material articles. If the feed drum 20 is utilized to feed newspaper sections to upwardly opening pockets of a rotary conveyor, the use of alignment rods may be omitted. It is also contemplated that the alignment rods may be omitted when the feed drum 20 is utilized to feed signatures to a saddle type conveyor.

In view of the foregoing description, it is believed to be apparent that the present invention provides a new and improved method and apparatus for handling sheet material articles 16. During operation of the apparatus, a drum 20 is rotated to feed sheet material articles from a hopper 12. The hopper 12 supports the sheet material articles in a stack 14 with front edge portions 28 of the sheet material articles 16 skewed at an acute angle 64 to an axis of rotation of the drum 20. A separator 32 is operable to engage a front edge portion 28 of a sheet material article 16 and to separate the front edge portion 28 of the sheet material article from a next succeeding sheet material article.

During rotation of the drum 20, grippers 26 on the drum grip the front edge portion 28 of the sheet material article 16. During continued rotation of the drum 20, the gripper 26 pull the gripped sheet material article 16 from the hopper 12 with the front edge portion 28 of the sheet material article skewed at an acute angle 64 to the axis 50 of rotation of the drum 20 and parallel to front edge portions 28 of other sheet material articles in the stack 14 of sheet material articles. As the gripped sheet material article 16 is pulled from the hopper 12, the sheet material article is moved along a path which is skewed relative to the sides of the stack of sheet material articles to expose the next succeeding sheet material article to the separator 32 during movement of the gripped sheet material article from the hopper 12.

A conveyor 22 receives the sheet material articles 16 from the feed drum 20 and moves the sheet material articles along a path, indicated by the arrow 42 in FIG. 1, which is skewed at the acute angle 68 to the stack 14 of sheet material articles. As each sheet material article 16 in turn moves from the feed drum 20 toward the conveyor 22, the sheet material article is rotated by alignment rods 92, 94, 96 and 98 to align the sheet material article with the conveyor 22.

Having described the invention, the following is claimed:

1. An apparatus for use in handling sheet material articles, said apparatus comprising hopper means for supporting a stack of sheet material articles, separator means for at least partially separating the front edge portion of the lowermost sheet material article in the stack of sheet material articles from the front edge portion of the next succeeding sheet material article in the stack of sheet material articles, said separator means including means for engaging a lower side of the front edge portion of the lowermost article in the stack of sheet material articles and pulling the front edge portion of the lowermost article downwardly away from the front edge portion of the next succeeding sheet material article in the stack of sheet material articles, and feed means for feeding sheet material articles from said hopper means, said feed means including a drum which is rotatable about an axis which is skewed at an acute angle to the front edge portions of sheet material articles in the stack of sheet material articles and gripper means connected with said drum means for rotation therewith, said gripper means being operable to grip the front edge portion of the lowermost sheet material article in the stack of sheet material articles while the front edge portion of the lowermost sheet material article is separate from the front edge portion of the next succeeding sheet material article in the stack of sheet material articles and to pull the lowermost sheet material article from said hopper means with the front edge portion of the lowermost sheet material article skewed at an acute angle to the axis of rotation of said drum to move the lowermost sheet material article from between said separator means and the next succeeding sheet material article while a portion of the lowermost sheet material article is being pulled from said hopper means by said gripper means.

2. An apparatus as set forth in claim 1 further including conveyor means for sequentially receiving sheet material articles from said feed means and for moving the sheet material articles along a path having a longitudinal central axis which is skewed at an acute angle to front edge portions of sheet material articles in the stack of sheet material articles.

3. An apparatus as set forth in claim 2 further including means for rotating each sheet material article in turn relative to said conveyor means as the sheet material article moves from said feed means toward said conveyor means to move the sheet material article into an orientation in which the sheet material article is aligned with said conveyor means.

4. An apparatus as set forth in claim 1 wherein said hopper means includes registration surface means which is skewed at the acute angle to the axis of rotation of said drum means and is engageable with the front edge portions of the sheet material articles in the stack of sheet material articles to locate the sheet material articles relative to said drum means.

5. An apparatus as set forth in claim 1 further including conveyor means for receiving sheet material articles fed from said hopper means with the front edge portions of the sheet material articles skewed at an acute angle to the front edge portions of sheet material articles in said hopper means.

6. An apparatus for use in handling sheet material articles, said apparatus comprising means for holding a stack of rectangular sheet material articles having parallel front and rear edge portions interconnected by parallel first and second side edge portions, each of the sheet material articles in the stack of sheet material articles having a first corner portion which is at least partially defined by the intersection of the front edge portion and first side edge portion of the sheet material article, separator means for engaging the first corner portion of each of the sheet material articles in the stack of sheet material articles in turn and for moving the first corner portion of each sheet material article in the stack of sheet material articles in turn out of engagement with the first corner portion of a next adjacent sheet material article in the stack of sheet material articles to sequentially move the front edge portions of the sheet material articles toward a pickup location, and feed means for gripping the front edge portion of each one of the sheet material articles in turn at the pickup location and for moving each one of the sheet material articles in turn from between said separator means and the first corner portion of a next succeeding sheet material article by moving the one sheet material article along a path which is skewed at an acute angle to the first side edge portions of the sheet material articles in the stack of sheet material articles to expose the first corner portion of the next succeeding sheet material article to said separator means during movement of the one sheet material article from the stack of sheet material articles by said feed means.

7. An apparatus as set forth in claim 6 further including conveyor means for receiving sheet material articles from said feed means and for moving the sheet material articles along a path which extends at the acute angle to the first side edge portions of the sheet material articles in the stack of sheet material articles.

8. An apparatus as set forth in claim 6 wherein said feed means moves the first side edge portion of the one sheet material article away form the first side edge portion of the next succeeding article in the stack of sheet material articles and toward the second side edge portion of the next succeeding article in the stack of sheet material articles as said feed means moves the one sheet material article from said means for holding a stack of sheet material articles.

9. An apparatus as set forth in claim 6 wherein said feed means includes drum means which is rotatable about an axis which is skewed at an acute angle to the front edge portions of sheet material articles in the stack of sheet material articles and gripper means which is connected with said drum means for rotation therewith, said gripper means being operable from an open condition to a closed condition to grip a front edge portion of a sheet material article.

10. An apparatus as set forth in claim 6 further including conveyor means for receiving sheet material articles and means for rotating each sheet material article in turn relative to said conveyor means to align each sheet material article in turn with said conveyor means.

11. An apparatus as set forth in claim 6 wherein said separator means includes sucker means for applying suction to a lowermost side of a lowermost sheet material article in the stack of sheet material articles and pulling downwardly on the lowermost side of the lowermost sheet material article in the stack of sheet material articles.

12. An apparatus as set forth in claim 6 further including conveyor means disposed beneath said feed means for sequentially receiving sheet material articles from said feed means and for conveying the sheet material articles along a path extending parallel to the path along which the sheet material articles are moved by said feed means.

13. An apparatus as set forth in claim 6 wherein said separator means is engageable with a lower side of the first corner portion of each sheet material article in the stack of sheet material articles in turn and is operable to pull the first corner portion of each sheet material article in turn downwardly away from the first corner portion of the next adjacent sheet material article in the stack of sheet material articles.

14. An apparatus as set forth in claim 13 wherein said feed means includes a drum which is disposed beneath the stack of sheet material articles and is rotatable about an axis which is skewed at an acute angle to the front edge portions of sheet material articles in the stack of sheet material articles and gripper means connected with said drum for rotation therewith.

15. An apparatus for use in handling sheet material articles, said apparatus comprising hopper means for supporting a stack of sheet material articles having front edge portions disposed along a first side of the stack of sheet material articles, feed means for sequentially feeding each of the sheet material articles from said hopper means along a feed path which is skewed at an acute angle to the first side of the stack of sheet material articles in said hopper means and with the front edge portions of the sheet material articles parallel to the first side of the stack of sheet material articles in said hopper means, conveyor means for sequentially receiving sheet material articles from said feed means and for sequentially moving the sheet material articles along a conveyor path which is skewed at an acute angle to the first side of the stack of sheet material articles, and alignment means disposed between said feed means and said conveyor means for engaging each of the sheet material articles in turn as it moves from said feed means toward said conveyor means to rotate each sheet material article in turn to an orientation in which the front edge portion of the sheet material article is skewed at an acute angle to the first side of the stack of sheet material and is aligned with said conveyor means.

16. An apparatus as set forth in claim 15 wherein said alignment means includes a plurality of elongated elements which extend along said conveyor means and have longitudinal axes which slope away from said feed means toward said conveyor means.

17. An apparatus as set forth in claim 16 further including separator means for at least partially separating the front edge portion of one sheet material article in the stack of sheet material articles from the front edge portion of the next succeeding sheet material article in the stack of sheet material articles, said separator means including means for engaging a side of the front edge portion of the one article and pulling the front edge portion of the one article away from the front edge portion of the next succeeding article in the stack of sheet material articles.

18. An apparatus as set forth in claim 17 wherein said feed means includes a drum which is rotatable about an axis which is skewed at an acute angle to the first side of the stack of sheet material articles and gripper means connected with said drum for rotation therewith, said gripper means being operable to grip the front edge portion of the one sheet material article while the front edge portion of the one sheet material article is separated from the front edge portion of the next succeeding sheet material article in the stack of sheet material articles and to pull the one sheet material article from said hopper means with the front edge portion of the one sheet material article skewed at an acute angle to the feed path and the axis of rotation of said drum to move the one sheet material article from between said separator means and the next succeeding sheet material article while a portion of the one sheet material article is being pulled from said hopper means by said gripper means.

19. A method of handling sheet material articles, said method comprising the steps of providing a stack of sheet material articles having front edge portions disposed along one side of the stack of sheet material articles, separating the front edge portions of the lowermost sheet material article in the stack of sheet material articles from the front edge portion of the next succeeding sheet material article in the stack of sheet material articles by pulling downwardly on a lower side of the front edge portion of the lowermost sheet material article in the stack of sheet material articles, gripping the front edge portion of the lowermost sheet material article in the stack of sheet material articles while the front edge portion of the lowermost sheet material article is separate from the front edge portion of the next succeeding sheet material, article, and, thereafter, pulling the lowermost sheet material article from the stack of sheet material articles while performing said step of gripping the front edge portion of the lowermost sheet material articles by moving the lowermost sheet material article along a path extending at an acute angle to the one side of the stack of sheet material article, said step of gripping the front edge portion of the lowermost sheet material article in the stack of sheet material articles including gripping the front edge portion of the lowermost sheet material with a gripper disposed on a rotatable drum, said step of pulling the lowermost sheet material article from the stack of sheet material articles includes rotating the drum about a central axis of the drum, said step of moving the lowermost sheet material article along a path which extends at an acute angle to the one side of the stack of sheet material articles includes rotating the drum about an axis which is skewed at an acute angle relative to the one side of the stack of sheet material articles.

20. A method of handling sheet material articles, said method comprising the steps of providing a stack of sheet material articles having front edge portions disposed along one side of the stack of sheet material articles, separating the front edge portions of the lowermost sheet material article in the stack of sheet material articles by pulling downwardly on a lower side of the front edge portion of the lowermost sheet material article in the stack of sheet material articles, gripping the front edge portion of the lowermost sheet material article in the stack of sheet material articles, gripping the front edge portion of the lowermost sheet material article in the stack of sheet material articles while the front edge portion of the lowermost sheet material article is separate from the front edge portion of the next succeeding sheet material article, and, thereafter, pulling the lowermost sheet material article from the stack of sheet material articles while performing said step of gripping the front edge portion of the lowermost sheet material article by moving the lowermost sheet material article along a path extending at an acute angle to the one side of the stack of sheet material articles, includes rotating the drum about an axis which is releasing the grip on the front edge portion of the lowermost sheet material article after the lowermost sheet material article has been pulled from the stack of sheet material articles, transferring the released sheet material article to a conveyor assembly, and operating the conveyor assembly to move sheet material articles along a path which is skewed at an acute angle to the one side of the stack of sheet material articles, said step of transferring the sheet material article to a conveyor assembly includes rotating the sheet material article relative to said conveyor assembly to align edge portions of the sheet material article with the conveyor assembly.

* * * * *

UNITED STATES PATENT AND TRADEMARK OFFICE
CERTIFICATE OF CORRECTION

PATENT NO. : 5,174,559

DATED : December 29, 1992

INVENTOR(S) : George J. Diamantides

It is certified that error appears in the above-identified patent and that said Letters Patent is hereby corrected as shown below:

Column 12, line 20, delete "includes".

Column 12, line 21, delete "rotating the drum about an axis which is".

Signed and Sealed this

Twenty-fifth Day of October, 1994

*Attest:*

*Attesting Officer*

Bruce Lehman

BRUCE LEHMAN

*Commissioner of Patents and Trademarks*